US011123783B2

(12) United States Patent
Lee et al.

(10) Patent No.: US 11,123,783 B2
(45) Date of Patent: Sep. 21, 2021

(54) HOT STAMPING DIE APPARATUS

(71) Applicants: MS AUTOTECH CO., LTD., Gyeongju-si (KR); MyungShin Industry Co., Ltd., Gyeongju-si (KR)

(72) Inventors: Hyun Woo Lee, Suwon-si (KR); Dae Ho Yang, Suwon-si (KR); Jang Soo Kim, Gwacheon-si (KR); Tae Kyu Lee, Seoul (KR)

(73) Assignees: MS AUTOTECH CO., LTD., Gyeongju-si (KR); MYUNGSHIN INDUSTRY CO., LTD., Gyeongju-si (KR)

( * ) Notice: Subject to any disclaimer, the term of this patent is extended or adjusted under 35 U.S.C. 154(b) by 247 days.

(21) Appl. No.: 16/197,474

(22) Filed: Nov. 21, 2018

(65) Prior Publication Data

US 2019/0201960 A1 Jul. 4, 2019

(30) Foreign Application Priority Data

Dec. 29, 2017 (KR) ..... 10-2017-0184870

(51) Int. Cl.
*B21D 22/02* (2006.01)
*B21D 37/16* (2006.01)
*B21D 37/02* (2006.01)

(52) U.S. Cl.
CPC ..... *B21D 22/022* (2013.01); *B21D 37/02* (2013.01); *B21D 37/16* (2013.01)

(58) Field of Classification Search
CPC ..... B21D 37/02; B21D 37/10; B21D 37/12; B21D 37/16; B21D 37/20; B21D 22/022; B21D 24/16
See application file for complete search history.

(56) References Cited

U.S. PATENT DOCUMENTS

2014/0260493 A1* 9/2014 Yoon ..... B21D 37/16 72/342.5
2014/0305181 A1* 10/2014 Kobayashi ..... B21D 22/208 72/342.5
2016/0059295 A1* 3/2016 Frost ..... B21D 22/022 72/354.6

FOREIGN PATENT DOCUMENTS

KR 20130076484 A * 7/2013

* cited by examiner

*Primary Examiner* — Debra M Sullivan
(74) *Attorney, Agent, or Firm* — STIP Law Group, LLC

(57) ABSTRACT

Provided is a hot stamping die apparatus including sub-assemblies constructed by making a plurality of plates erect and sequentially overlapping the plurality of plates in a face-to-face manner. A first cooling channel extending along overlapping surfaces is provided by forming grooves corresponding to each other on overlapping surfaces of adjacent plates, A second cooling channel passing through the corresponding sub-assembly in the length direction is provided in at least one of the sub-assemblies.

3 Claims, 8 Drawing Sheets

Prior Art

[FIG. 2]

[FIG. 3]
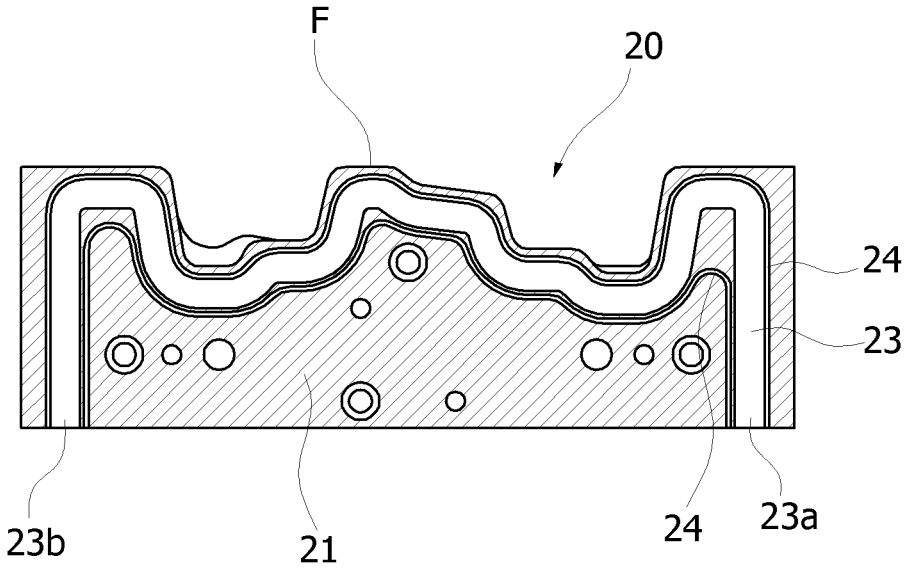
[FIG. 4]
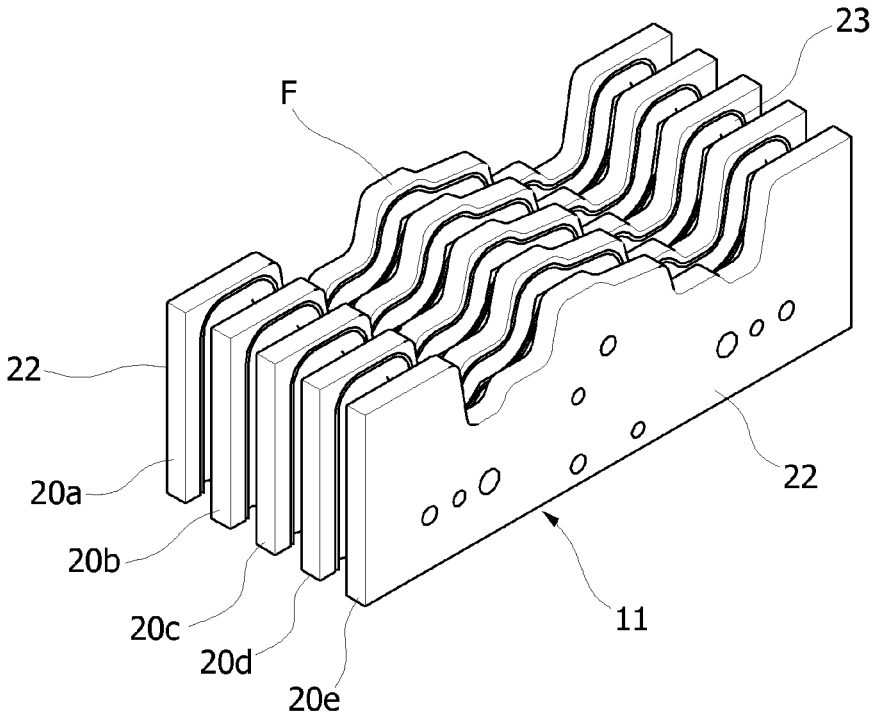

[FIG. 5]
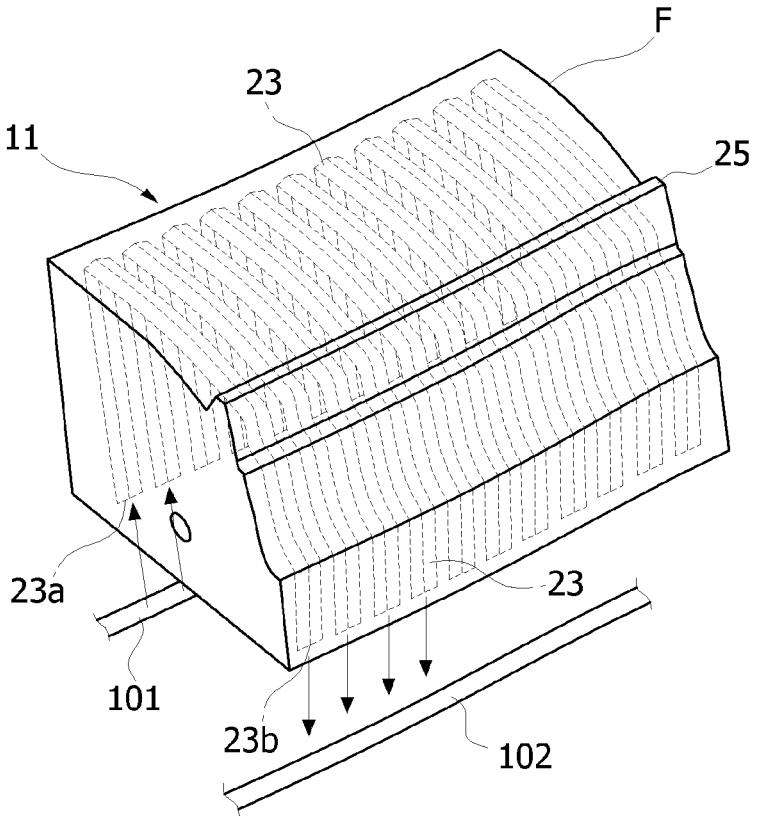

[FIG. 6]
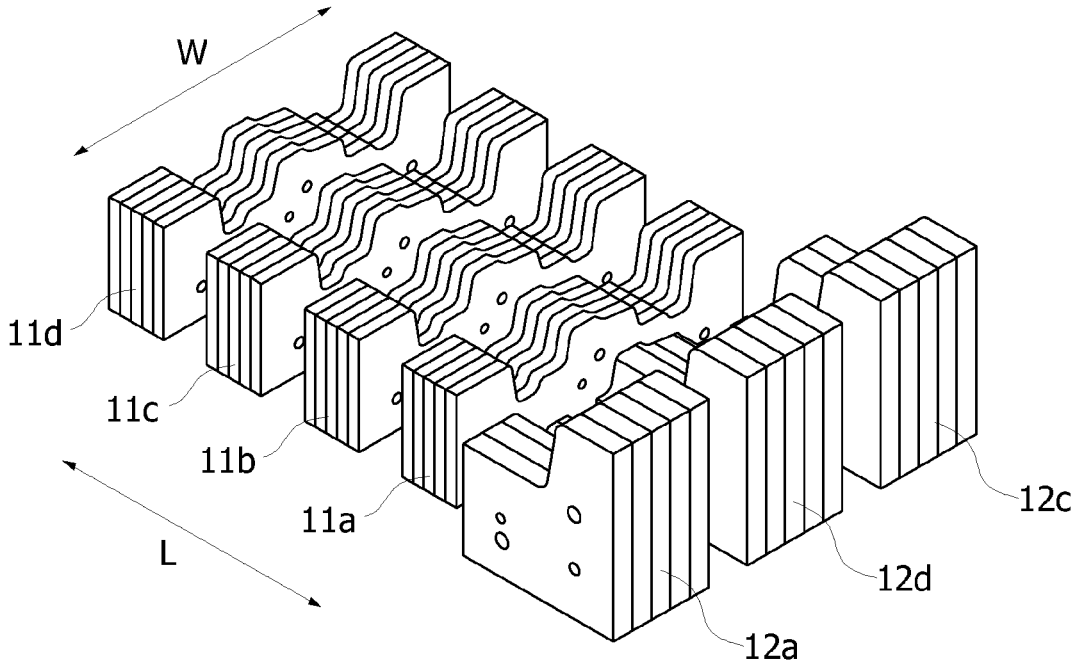
[FIG. 7A]
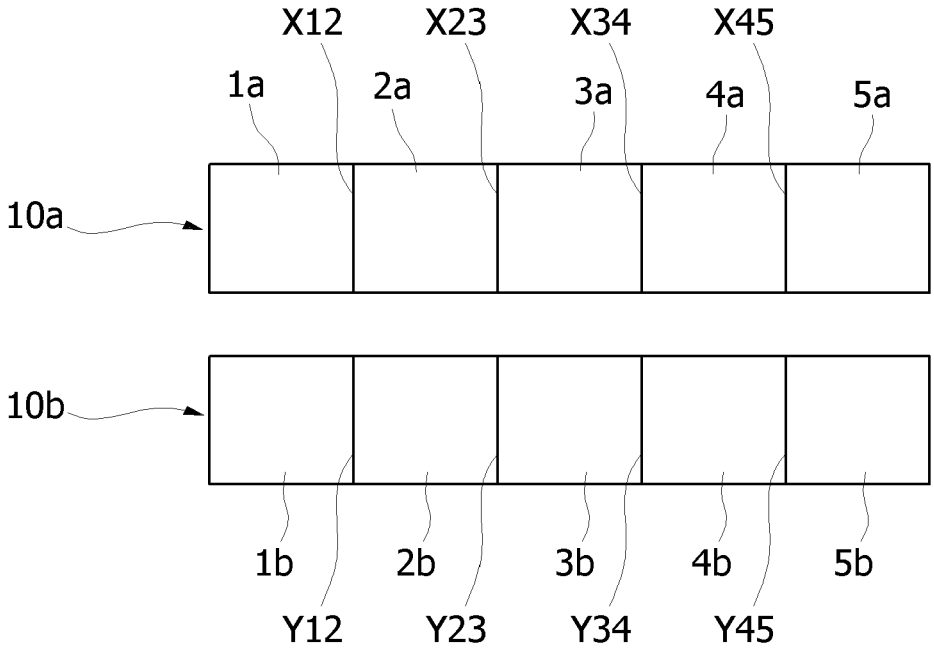

[FIG. 7B]
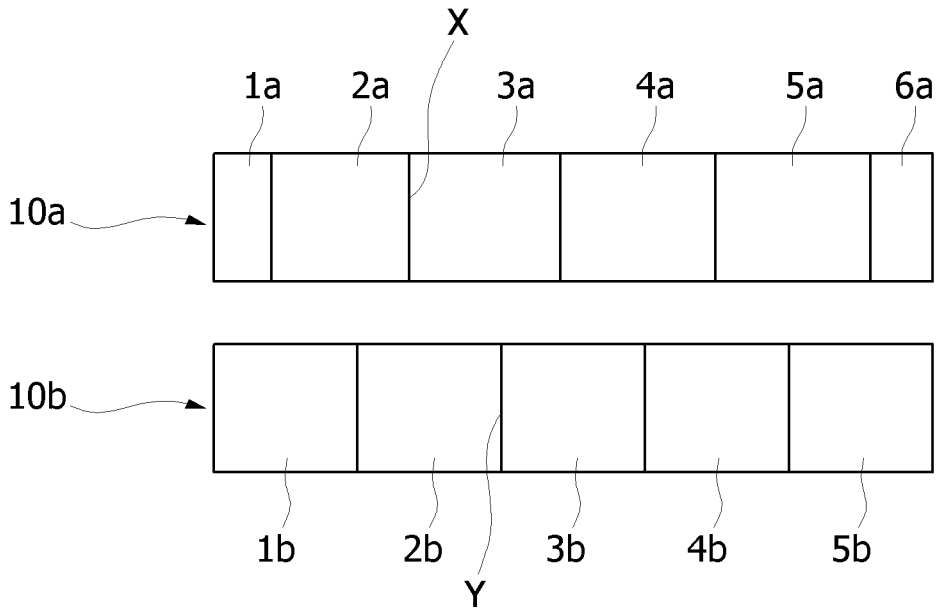
[FIG. 8]
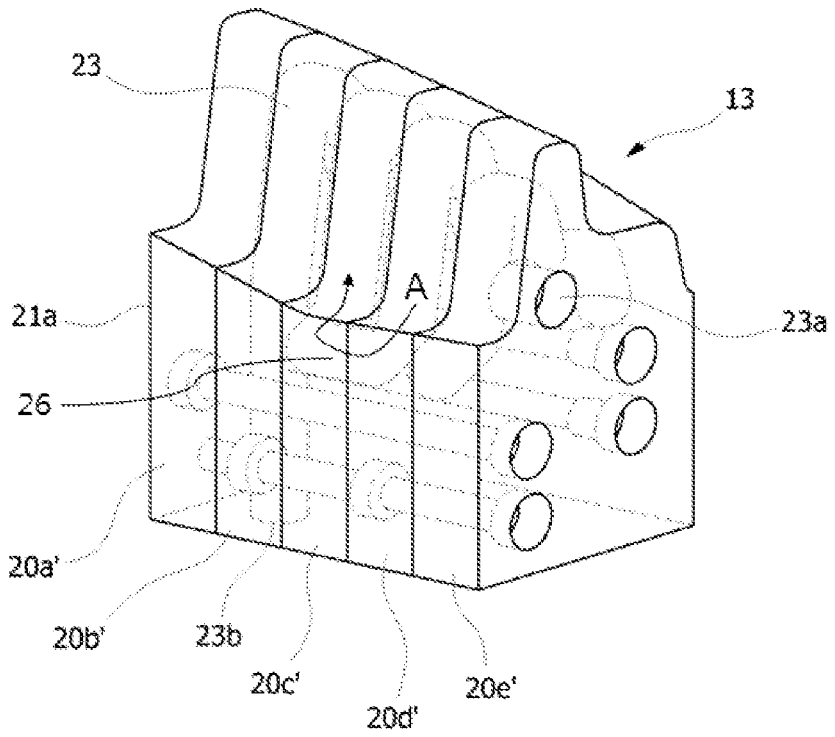

[FIG. 9]
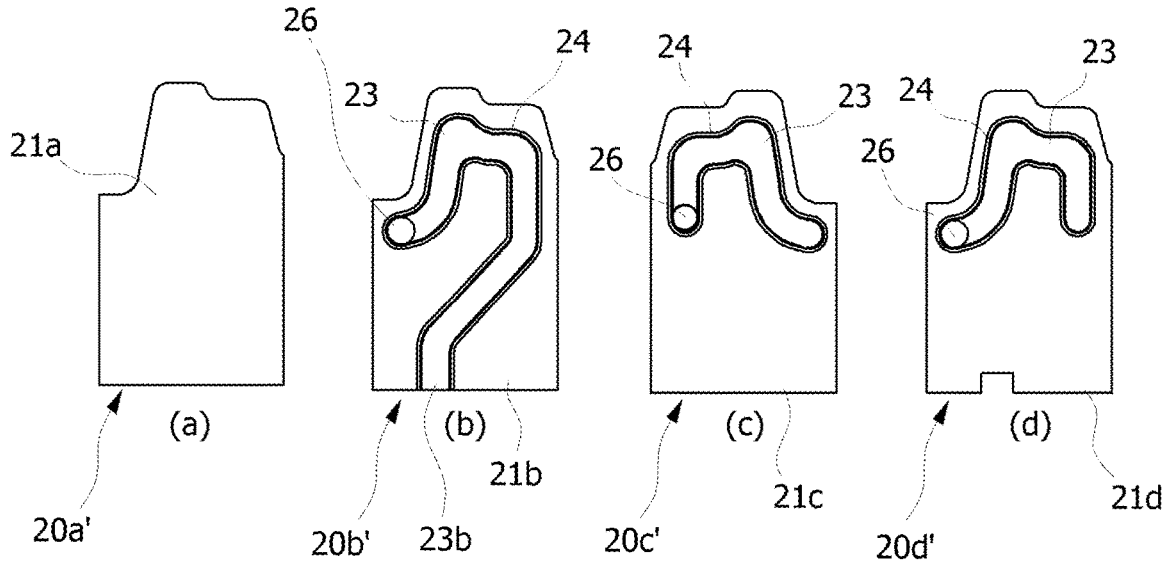
[FIG. 10]
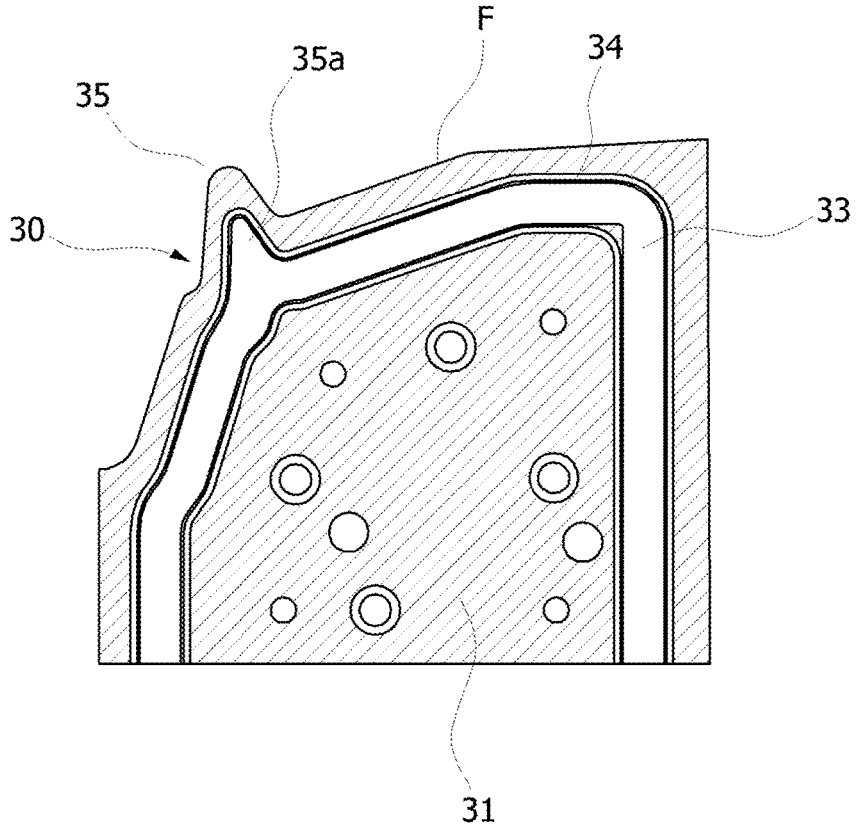

[FIG. 11]
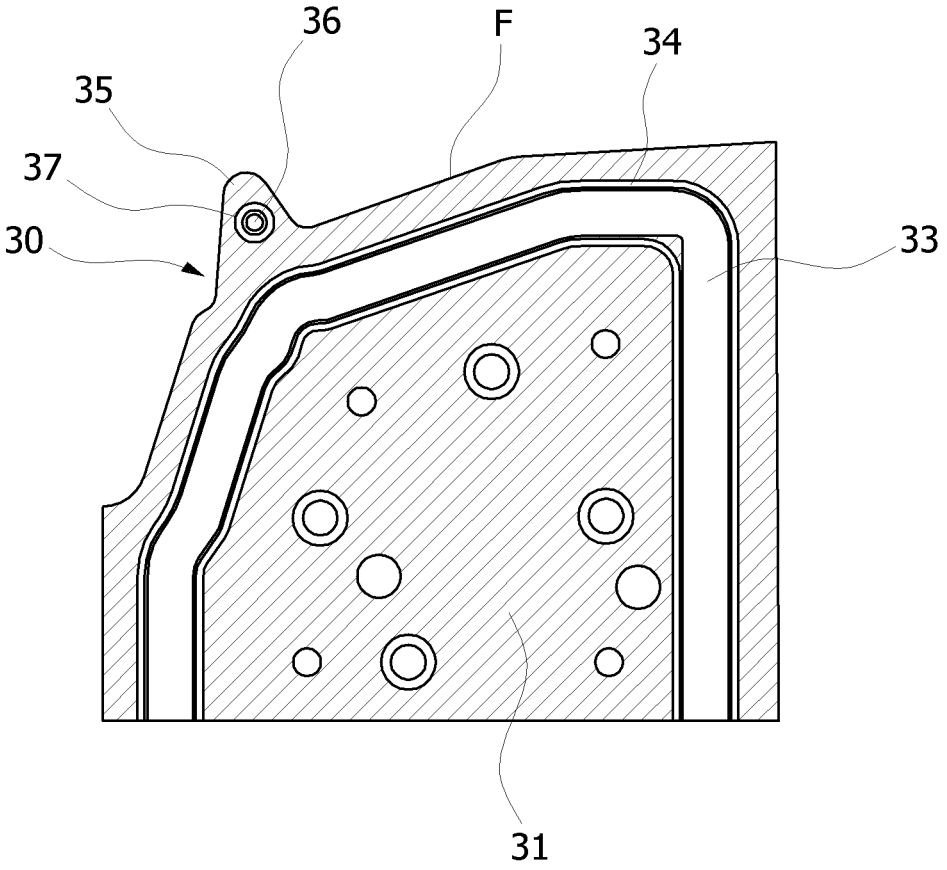

[FIG. 12]
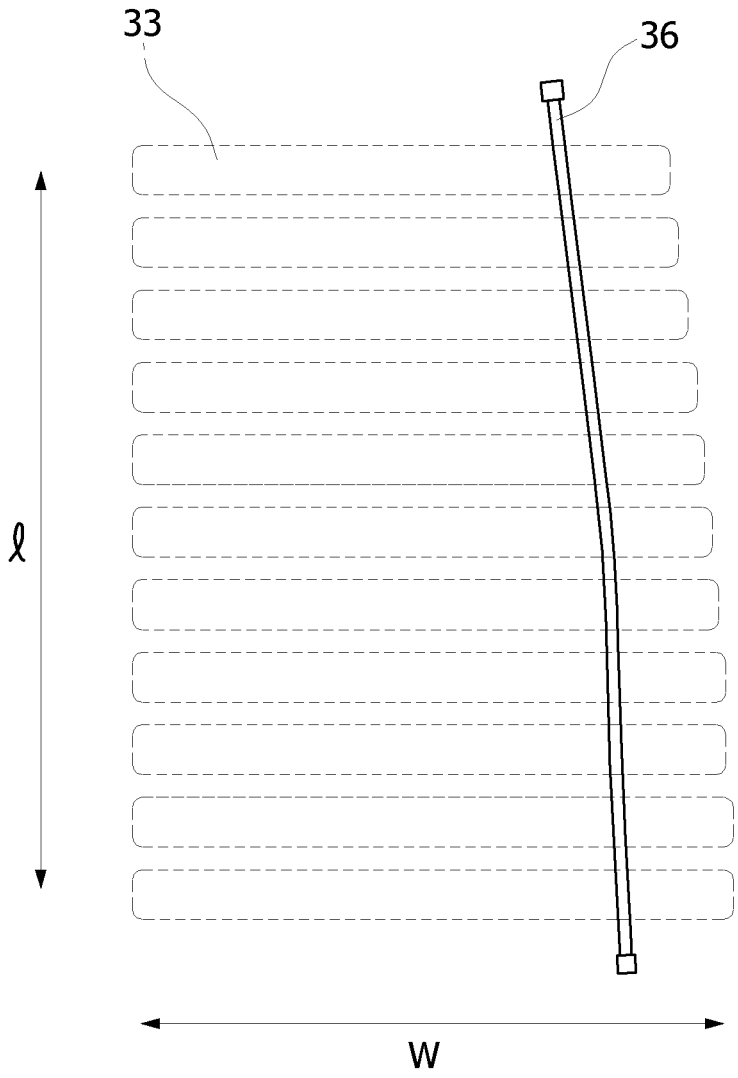

HOT STAMPING DIE APPARATUS

CROSS-REFERENCE TO RELATED APPLICATION

This application claims the benefit of Korean Patent Application No. KR 10-2017-0184870 filed on Dec. 29, 2017, the disclosure of which is incorporated herein in its entirety by reference.

BACKGROUND

The present invention relates to a hot stamping die apparatus, and more particularly, to a hot stamping die apparatus having excellent cooling performance.

As the fuel efficiency regulations or safety regulations have recently been strengthened, the biggest issue is the weight reduction and strength increase of vehicle parts. In the domestic and overseas vehicle manufacturing industry, the application of hot stamping parts tends to be drastically expanded. The hot stamping is disclosed in GB Patent No. 1490535.

In the hot stamping, a steel sheet is heated to above an austenitizing temperature, for example, 900° C. or higher, press-formed, and quenched to produce a high strength steel part. In order to prevent oxidation of the steel sheet heated to a high temperature, a steel plate coated with Al or Zn is used on the surface. As an example of an Al-coated steel sheet, there is Usibor 1500 based on boron steel 22MnB5.

An important concern in the manufacture of vehicle parts using hot stamping is productivity and quality. As a method for improving the productivity of the hot stamping process, U.S. Pat. No. 9,631,248 proposes a heating furnace in which a high-frequency induction heating furnace is combined with an electric furnace. One of the major factors affecting the quality of hot stamping parts is cooling performance of a die.

As illustrated in FIG. 1, a conventional hot stamping die 500 is manufactured by assembling a plurality of sub-assemblies 502 each having a forming surface 504. The sub-assemblies 502 are provided with cooling channels 506 formed in the longitudinal direction of the die 500. The cooling channels 506 are formed by gun drilling. As a distance from the forming surface 504 to the cooling channel 506 is shorter, the cooling performance is better. However, since the die 500 has a three-dimensional complicated shape, it is not easy to shorten the distance.

SUMMARY

The present invention is based on the recognition of the related art described above, and provides a hot stamping die apparatus having excellent cooling performance.

Also, the present invention provides a hot stamping die apparatus capable of uniformly and effectively cooling a forming surface of a die even when a molded product to be manufactured has a complicated shape and thus a forming surface of a die has a complicated shape.

The problems to be solved by the present invention are not necessarily limited to those mentioned above, and other problems not mentioned herein may be understood by the following description.

According to the present invention, a hot stamping die apparatus includes: a first die having a first forming surface; and a second die having a second forming surface corresponding to the first forming surface, wherein each of the first die and the second die includes a plurality of sub-assemblies connected to each other.

According to the present invention, the sub-assemblies may be constructed by making a plurality of plates erect and sequentially overlapping the plurality of plates in a face-to-face manner. A first cooling channel extending along overlapping surfaces may be provided by forming grooves corresponding to each other on overlapping surfaces of adjacent plates.

According to the present invention, at least one of the sub-assemblies may be provided with a second cooling channel passing through the corresponding sub-assembly in the length direction, and the second cooling channel may be disposed between the forming surface and the first cooling channel of the sub-assembly.

According to the present invention, when the first die and the second die are closed, first overlapping surfaces between the sub-assemblies constituting the first die and second overlapping surfaces between the sub-assemblies constituting the second die are arranged to be misaligned.

According to the present invention, at least one of the first die and the second die has a first sub-assembly array in which the plates are arranged in the length direction of the die and a second sub-assembly array in which the plates are arranged in the width direction of the die.

BRIEF DESCRIPTION OF THE DRAWINGS

Embodiments of the present invention will be more clearly understood from the following detailed description taken in conjunction with the accompanying drawings in which:

FIG. 2 illustrates a hot stamping die according to an embodiment of the present invention;

FIG. 3 illustrates a die plate according to an embodiment of the present invention;

FIG. 4 illustrates an example of a sub-assembly including die plates according to an embodiment of the present invention;

FIG. 5 illustrates a structure of a cooling channel in the sub-assembly according to an embodiment of the present invention;

FIG. 6 illustrates a hot stamping die according to another embodiment of the present invention;

FIGS. 7A and 7B illustrate a hot stamping die apparatus according to an embodiment of the present invention;

FIG. 8 illustrates a sub-assembly according to another embodiment of the present invention;

FIG. 9 illustrates an example of die plates constituting the sub-assembly as illustrated in FIG. 8;

FIG. 10 illustrates a die plate according to another embodiment of the present invention;

FIG. 11 illustrates a die plate according to another embodiment of the present invention; and FIG. 12 illustrates a structure of a cooling channel when a sub-assembly is constituted by using the die plates illustrated in FIG. 11.

DETAILED DESCRIPTION OF THE EMBODIMENTS

Figure 1:
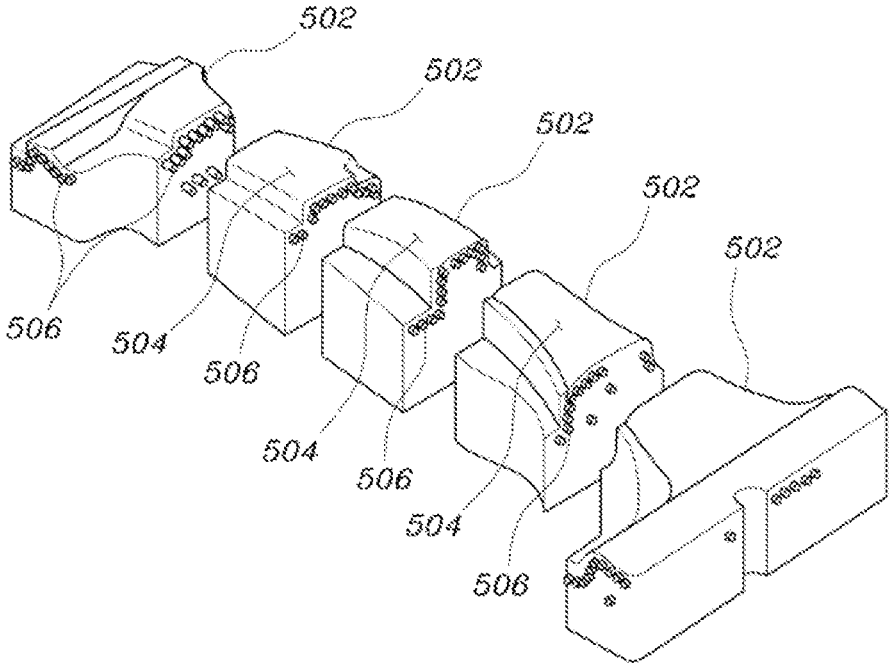
FIG. 1 illustrates an example of a conventional hot stamping die.
Figure 1:
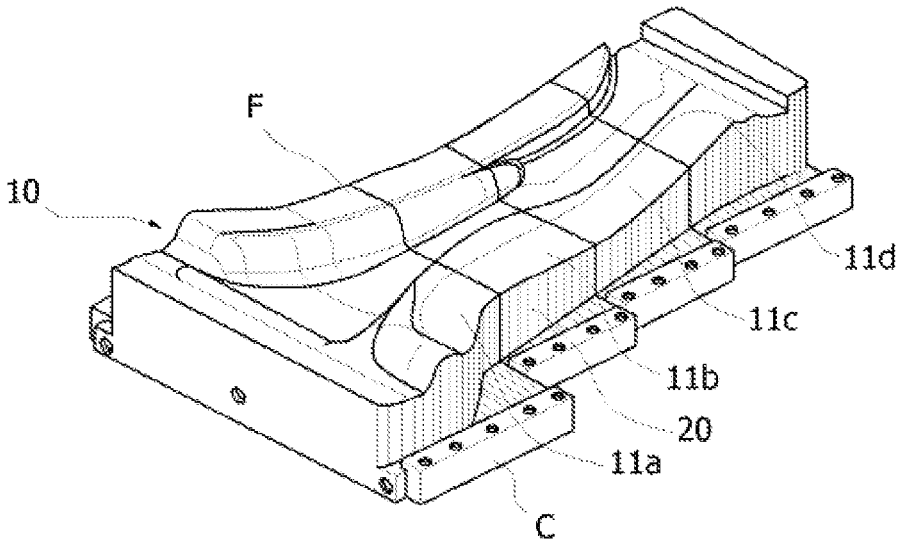

Hereinafter, exemplary embodiments of the present invention will be described in detail with reference to the accompanying drawings. In the accompanying drawings, the same or equivalent components or parts are denoted by the same reference numerals as much as possible for convenience of description, and the drawings may be exaggerated and schematically illustrated for a clear understanding and explanation of the features of the invention.

In the description of the present invention, unless otherwise specified, that a second element is disposed "on" a first element or two elements are "connected" to each other means that two elements are directly contacted or connected to each other, and allows the interrelation between the first and second elements through a third element. Directional expressions such as forward, backward, left and right, or up and down are merely for convenience of description.

FIG. 2 illustrates a die 10 according to an embodiment. Referring to FIG. 2, the die 10 includes sub-assemblies 11 (11*a*, 11*b*, 11*c*, 11*d*). An upper surface of each of the sub-assemblies 11 forms a forming surface F for imparting a shape to a part, and a lower portion thereof may be fixed by a clamp C. Each of the sub-assemblies 11 includes a plurality of plates 20.

Referring to FIG. 3, a groove constituting a cooling channel 23 is formed on one surface 21 of the plate 20. Sealing grooves 24 are provided along the groove at both edges in the width direction of the groove. An O-ring (not illustrated) for sealing the cooling channel 23 is inserted into the sealing grooves 24. The cooling channel 23 is preferably formed as close as possible to the forming surface F. Since the groove constituting the cooling channel 23 is formed by machining the surface of the plate 20, the cooling channel 23 can be formed as close as possible to the forming surface even if the forming surface F has a complicated shape. The cooling channel 23 may be formed along the surface of the plate 20, and have inlet 23*a* and outlet 23*b*.

Referring to FIG. 4, the sub-assembly 11 is manufactured by making a plurality of plates 20 (20*a*, 20*b*, 20*c*, 20*d*, 20*e*) erect and sequentially overlapping the plurality of plates 20 in a face-to-face manner. A fixing member for assembling the plates 20 may be provided between the plates 20, and the upper surface of each of the plates 20 may form the forming surface F. Grooves corresponding to each other are formed so as to form the circular cooling channel 23 on the overlapping surface between the adjacent plates 20.

The two plates 20*a* and 20*e* disposed at the outermost among the five plates 20 sequentially overlapped in FIG. 4 have only one overlapping surface with the adjacent plates 20*b* and 20*d*, respectively. In the outermost plates 20*a* and 20*e*, the cooling channel 23 is formed on only one side thereof. In the remaining three plates 20*b*, 20*c*, and 20*d*, the cooling channels 23 are formed on both sides thereof. The cooling channels 23 may not be formed on both side surfaces 22 of the sub-assembly 11 in consideration of the assembling convenience between the sub-assemblies 11 and the sealing of the cooling channels 23. This side surface 22 is a surface that is in contact with the other sub-assembly.

FIG. 5 illustrates the cooling channels 23 in the sub-assembly 11. The sub-assembly 11 is fixed to a base (not illustrated) of the die apparatus, and the base is provided with passages 101 and 102 for supplying cooling water to the cooling channels 23 of the sub-assembly 11. The cooling water is supplied through a supply passage 101, flows along the cooling channels 23 provided on the overlapping surfaces between the plates 20, and is then discharged to a discharge passage 102. The inlet 23*a* and the outlet 23*b* of the cooling channel 23 may be provided on each of the overlapping surfaces between the plates 20.

FIG. 6 illustrates a die according to another embodiment. Referring to FIG. 6, four sub-assemblies 11*a*, 11*b*, 11*c*, and 11*d* may form a first sub-assembly array arranged in a length direction L of a die, and three sub-assemblies 12*a*, 12*b*, and 12*c* may form a second sub-assembly array arranged in a width direction W of the die. The cooling channels 23 are not formed on both side surfaces of the sub-assembly 11. Therefore, when the sub-assemblies are arranged in only one direction, the contact portions between the sub-assemblies 11 are regularly arranged to cause deterioration of the cooling performance.

FIG. 7A illustrates a hot stamping die apparatus according to an embodiment. Referring to FIG. 7A, overlapping surfaces between sub-assemblies 1*a*, 2*a*, 3*a*, 4*a*, and 5*a* constituting an upper die 10*a* are first overlapping surfaces X (X12, X23, X34, X45). Overlapping surfaces between sub-assemblies 1*b*, 2*b*, 3*b*, 4*b*, and 5*b* constituting a lower die 10*b* are second overlapping surfaces Y (Y12, Y23, Y34, Y45). In a case where the first overlapping surfaces X and the second overlapping surfaces Y are placed at the same position or on the same line when the die apparatus is closed, the cooling performance in the vicinity of the overlapping surfaces X and Y is poor as compared with the other portions. Since cooling channels 23 are not formed on both side surfaces of each sub-assembly, the cooling performance in the vicinity of the overlapping surfaces between the assemblies is poor. In addition, when the first overlapping surface X and the second overlapping surface Y are arranged on the same line, the cooling performance in the vicinity of the first and second overlapping surfaces X and Y becomes worse.

FIG. 7B illustrates a hot stamping die apparatus according to another embodiment. As illustrated in FIG. 7B, the first overlapping surface X and the second overlapping surface Y are not disposed at positions matching each other and are misaligned. As shown in the example of FIG. 7A, the cooling performance deterioration portions caused by the overlapping surfaces X and Y do not appear at regular intervals.

FIG. 8 illustrates a sub-assembly 13 according to another embodiment. An inlet 23*a* of a cooling channel 23 is provided on one side of the sub-assembly 13, and an outlet 23*b* of the cooling channel 23 is provided on the bottom of the sub-assembly 13. As in the previous embodiment, grooves constituting the cooling channel 23 are formed on the overlapping surfaces between plates 20. The cooling water flows through fourth, third, and second plates 20*d*', 20*c*', and 20*b*'. As an example, the cooling water is introduced from the inlet 23*a* of the fifth plate 20*e*', flows along the cooling channel 23 provided on the overlapping surface between the fourth and fifth plates 20*d*' and 20*e*', and flows to the cooling channel 23 provided on the overlapping surface between the third and fourth plates 20*c*' and 20*d*'. The second, third, and fourth plates 20*b*', 20*c*', and 20*d*' are provided with through-holes 26 (see FIG. 9) such that a cooling channel 23 formed on one surface of the plate is connected to a cooling channel 23 formed on the other surface thereof.

FIG. 9 illustrates the plates 20 constituting the sub-assembly 13 illustrated in FIG. 8. The plates 20 of FIG. 9 are illustrated so as to explain the structure of the sub-assembly 13 of FIG. 8, and the plates 20 of FIGS. 8 and 9 are not necessarily the same as each other.

Referring to FIG. 9, the cooling channel is not formed on the front surface 21*a* of the first plate 20*a*', and the cooling channel (not illustrated) is formed on the rear surface thereof. The front surface 21*b* of the second plate 20*b* overlaps the rear surface of the first plate 20*a*'. A cooling channel having a shape corresponding to the cooling channel 23 formed on the front surface 21*b* of the second plate 20*b* is formed on the rear surface of the first plate 20*a*. The second plate 20*b*' is provided with a through-hole 26 such that the cooling water flowing along the cooling channel 23 formed on the front surface 21*b* can be supplied from the third plate 20*c*'. The rear surface of the third plate 20*c*' overlaps the rear surface of the second plate 20*b*'. Cooling channels 23 corresponding to each other are formed on the rear surfaces of the second plate 20*b*' and the third plate 20*c*'. The third plate 20*c*' is also provided with a through-hole 26 such that the cooling water flowing along the cooling channel 23 formed on the rear surface of the third plate 20*c*' can be supplied from the fourth plate 20*d*'. The front surface 21*d* of the fourth plate 20*d*' overlaps the front surface 21*c* of the third plate 20*c*', and cooling channels 23 corresponding to each other are formed on the front surfaces 21*c* and 21*d* of the third plate 20*c*' and the fourth plate 20*d*'. The fourth plate 20*d*' is also provided with a through-hole 26 such that the cooling water can be supplied to or from a cooling channel 23 formed on the rear surface of the fourth plate 20*d*'.

According to the embodiment illustrated in FIGS. 8 and 9, the cooling water flows through the plates 20 while turning in a left and right direction in a zigzag. For example, referring to FIG. 8, the cooling water flowing from the right to the left along the cooling channel 23 formed in the overlapping surface of the third plate 20*c*' and the fourth plate 20*d*' passes through the left through-hole 26 and then flows to the right along the cooling channel 23 formed in the overlapping surface of the second plate 20*b*' and the third plate 20*c*'. Then, again, the cooling water flowing to the right along the cooling channel 23 formed in the overlapping surface of the second plate 20*b*' and the third plate 20*c*' may pass through the right through-hole (not illustrated in FIG. 8), flow to the left along the cooling channel 23 formed in the overlapping surfaces of the first plate 20*a*' and the second plate 20*b*' and then be discharged through the outlet 23*b*. In the embodiment illustrated in FIGS. 8 and 9, it is possible to form the cooling channels 23 by a required length at a position required for cooling and also reduce pressure load for supplying the cooling water, as compared with the embodiment illustrated in FIG. 5. The reduction in the pressure load may alleviate the burden of the sealing of the cooling channel 23 and the tolerance management in assembling the sub-assemblies 13.

Referring to FIG. 10, a protrusion 35 having a narrow width and a sharply bent portion may be provided on the forming surface F of the plate 30. In this case, a bent portion as indicated by reference numeral 35*a* may be formed in the cooling channel 33 such that the cooling channel 33 is formed as close as possible to the forming surface F. However, the flow of the cooling water in the slightly sharply bent portion 35*a* is not good and the periphery thereof is not sufficiently cooled. Reference numeral 34 denotes a sealing groove into which an O-ring is inserted. For reference, the protrusion 35 may be formed in the length direction of the sub-assembly 11 as indicated by reference numeral 25 in FIG. 5.

Referring to FIGS. 11 and 12, when there is a portion which is not cooled well like the above-described protrusion 35, a second cooling channel 36 may be provided in the length direction of the sub-assembly while passing through the protrusions 35 of the plates 30 in the length direction of the sub-assembly. Reference numeral 37 denotes a groove into which an O-ring for sealing is inserted. The second cooling channel 36 is disposed between the forming surface F of the corresponding sub-assembly and the first cooling channel 33. FIG. 12 corresponds to a view from above the sub-assembly 11 illustrated in FIG. 5. In FIG. 12, the first cooling channel 33 is indicated by a dashed line, the second cooling channel 36 is indicated by a solid line, l represents the length direction of the sub-assembly, and w represents the width direction of the sub-assembly.

A chemical refrigerant may be supplied to the second cooling channel 36. A refrigerant of a saturated liquid state (or a state close thereto) may be supplied to the inlet of the second cooling channel 36, and a refrigerant of a saturated gas state (or a state close thereto) may be discharged to the outlet of the second cooling channel 36. The molding surface F is cooled by the evaporation enthalpy or latent heat of the refrigerant passing through the second cooling channel 36. Due to this, the refrigerant temperature can be kept equal over the whole of the second cooling channel 36. If the refrigerant temperature is kept equal, uniform cooling of the molding surface F is possible.

According to the present invention as described above, the cooling channel can be formed to be close to the forming surface along the bending or shape of the forming surface. Therefore, the cooling performance of the die is improved.

Also, according to the present invention, the forming surface of the die can be uniformly and effectively cooled even when the molded product has a complicated shape and thus a forming surface of a die has a complicated shape.

While specific embodiments of the present invention have been illustrated and described, it will be understood by those skilled in the art that changes may be made to those embodiments without departing from the spirit and scope of the invention that is defined by the following claims.

What is claimed is:

1. A hot stamping die apparatus comprising:

a first die having a first forming surface; and a second die having a second forming surface corresponding to the first forming surface, wherein each of the first die and the second die comprises a plurality of sub-assemblies connected to each other, each of the sub-assemblies is formed by sequentially overlapping a plurality of plates in a face-to-face manner and has a plurality of first cooling channel provided by forming grooves correspondingly on respective overlapping surfaces of adjacent plates along the forming surfaces, the sub-assemblies include a first sub-assembly provided with a second cooling channel formed in a length direction of the first sub-assembly such that the second cooling channel passes through the plates, and the second cooling channel is disposed between the forming surface and the first cooling channels of the first sub-assembly, the sub-assemblies include a second sub-assembly having through-holes provided in the plates of the second sub-assembly such that the first cooling channels are connected to each other between adjacent plates to form a continuous cooling channel, the second sub-assembly having an inlet of the continuous channel at a first end of the second sub-assembly and an outlet of the continuous channel at a second end of the second sub-assembly, and the continuous channel extends in a length direction of the second sub-assembly to make a zigzag pattern, and the hot stamping die is constructed such that first overlapping surfaces between the sub-assemblies of the first die and second overlapping surfaces between the sub-assemblies of the second die are arranged to be misaligned when the first die and the second die are closed.

2. The hot stamping die apparatus of claim 1, wherein the sub-assemblies include a first sub-assembly array in which the plates are arranged in a length direction of the die and a second sub-assembly array in which the plates are arranged in a width direction of the die.

3. The hot stamping die apparatus of claim 1, wherein the hot stamping die apparatus is configured such that a chemical refrigerant is supplied to the second cooling channel and maintains a constant temperature in the second cooling channel.

* * * * *